United States Patent [19]

Taguchi et al.

[11] Patent Number: 4,939,969

[45] Date of Patent: Jul. 10, 1990

[54] ACOUSTIC KEYBOARD MUSICAL INSTRUMENT

[75] Inventors: Hanzo Taguchi; Rokurota Mantani; Masatosi Murayama; Toshihiro Nishino, all of Hamamatsu, Japan

[73] Assignee: Nippon Gakki Seizo Kabushiki Kaisha, Hamamatsu, Japan

[21] Appl. No.: 267,722

[22] Filed: Nov. 3, 1988

Related U.S. Application Data

[63] Continuation of Ser. No. 11,498, Feb. 5, 1987, abandoned.

[30] Foreign Application Priority Data

Feb. 6, 1986 [JP] Japan ..... 61-25231

[51] Int. Cl.[5] ..... G10C 3/04; G10H 5/00

[52] U.S. Cl. ..... 84/719; 84/171; 84/478

[58] Field of Search ..... 84/1.01, 1.16, 477 R, 84/478, 170–172

[56] References Cited

U.S. PATENT DOCUMENTS

| | | | |
|---|---|---|---|
| 2,933,004 | 4/1960 | Hanert | 84/1.01 |
| 3,482,028 | 12/1969 | Cox et al. | 84/1.16 |
| 3,786,167 | 1/1974 | Borell et al. | 84/1.16 |
| 3,871,247 | 3/1975 | Bonham | 84/1.16 |
| 4,226,154 | 10/1980 | Easler | 84/1.01 |
| 4,342,244 | 8/1982 | Perkins | 84/1.01 |
| 4,448,103 | 5/1984 | Blakely et al. | 84/1.01 |
| 4,601,361 | 7/1986 | Nakada | 84/1.01 X |
| 4,686,880 | 8/1987 | Salani et al. | 84/1.01 |
| 4,704,931 | 11/1987 | Nagai et al. | 84/172 X |

FOREIGN PATENT DOCUMENTS

| | | | |
|---|---|---|---|
| 2924381 | 2/1981 | Fed. Rep. of Germany | 84/1.16 |
| 0049120 | 4/1979 | Japan | 84/1.16 |
| 0614303 | 11/1979 | Switzerland | 84/1.01 |

*Primary Examiner*—Stanley J. Witkowski

*Attorney, Agent, or Firm*—Blakely, Sokoloff, Taylor and Zafman

[57] ABSTRACT

An acoustic keyboard musical instrument such as a piano includes a keyboard, a mechanical musical tone generating mechanism, a fallboard, and an operation panel for an external electronic musical tone generating unit. The keyboard includes a plurality of keys aligned on a musical instrument body. The fallboard is pivotally supported by the musical instrument body and to be closed/opened so as to cover/uncover the keyboard. The musical tone generating unit electrically generates a musical tone signal in response to a key depression on the keyboard under the control of control information which is provided by switches on the operation panel. The operation panel is located at a position opposite to a performer in the inner surface of the fallboard when the fallboard is open so that the performer can operate the operation panel during his performance at the keyboard.

5 Claims, 5 Drawing Sheets

ACOUSTIC KEYBOARD MUSICAL INSTRUMENT

This is a continuation of Ser. No. 011,498, filed 2/5/87, now abandoned.

BACKGROUND OF THE INVENTION

The present invention relates to an acoustic keyboard musical instrument such as a piano and, more particularly, to a keyboard musical instrument which can simultaneously drive an electronic musical instrument such as an electronic musical synthesizer.

In a recently proposed system, a keyboard musical instrument belonging to an acoustic musical instrument such as a grand piano is connected to another electronic musical instrument to allow simultaneous performance therewith. A conventional system of this type is shown in FIG. 5. Reference numeral 51 in FIG. 5 denotes a grand piano. The grand piano 51 comprises a mechanical vibration sound source designed such that depression of a key is mechanically transmitted by an action mechanism, and that the corresponding hammer is driven to strike the corresponding taut strings, thus producing the musical toner corresponding to the depressed key. The grand piano 51 also comprises a key depression detector for detecting depression of a key. The key depression detector may be a conventional key switch circuit arranged in a conventional electronic musical instrument or a contactless detection device of photo-sensor type which is also known. The key depression detector in the grand piano is connected to an input terminal of a musical tone generator in an electronic keyboard musical instrument (electronic musical instrument) 52 through a cable 53. The electronic keyboard musical instrument 52 is connected to a sound system 54 through a cable 55.

In the grand piano 51, the mechanical vibration sound source produces a musical tone upon depression of a key, and the key depression detector sends a key-on signal corresponding to the depressed key to the electronic keyboard musical instrument 52. The musical tone signal generated by the musical tone generator in the electronic keyboard musical instrument 52 is supplied to the sound system 54. A musical tone is thus produced at the sound system 54. Depression of a key in the grand piano 51 causes sound generation of the mechanical vibration sound source in the grand piano 51 and operation of the electronic keyboard musical instrument 52. In this manner, the grand piano 51 and the electronic keyboard musical instrument 52 can be simultaneously operated by one performer.

In the conventional grand piano 51 as described above, the performer at the grand piano 51 must operate the control switches of the electronic keyboard musical instrument 52 to control the musical tones generated by the sound system 54. When the performer at the grand piano 51 must adjust these control switches, he must interrupt his performance at the grand piano. During the performance, he cannot adjust the musical tone signals generated by the electronic keyboard musical instrument 52. As a result, he undesirably experiences limitations of his musical expressions.

SUMMARY OF THE INVENTION

It is, therefore, a principal object of the present invention to provide an acoustic keyboard musical instrument for allowing a performer to easily adjust musical tones generated by an electronic musical instrument operated simultaneously with the keyboard musical instrument, thereby allowing the performer to enjoy various musical expressions.

In order to achieve the above object of the present invention, there is provided an acoustic keyboard musical instrument capable of driving an external electronic musical tone generating means, comprising: a mechanical musical tone generating mechanism; a keyboard including a plurality of keys aligned on a musical instrument body to drive the mechanical tone generating mechanism and to produce signals to drive the external electronic tone generating means; a fallboard pivotally supported to the musical instrument body and to be closed/opened so as to cover/uncover the keyboard; and musical tone controlling means for controlling tones generated by the external electronic tone generating means and including a manual setting section for allowing a performer to set control information for the external electronic tone generating means, and the manual setting section being located at a position opposite to the performer in an inner surface of the fallboard when the fallboard is open.

DESCRIPTION OF THE PREFERRED EMBODIMENT

FIGS. 1 to 4 show a keyboard musical instrument according to an embodiment of the present invention.

Figure 1:
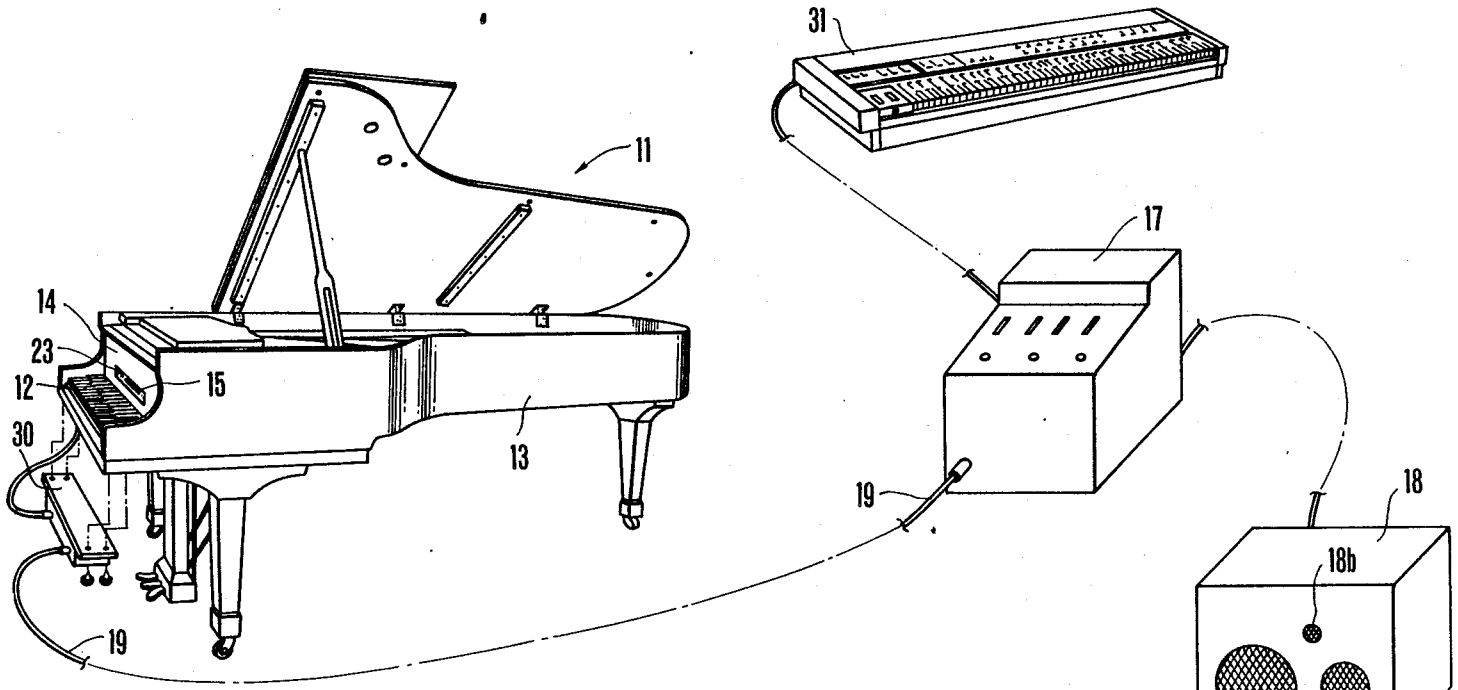
FIG. 1 is a perspective view showing connections of a keyboard musical instrument according to an embodiment of the present invention.
Figure 2:
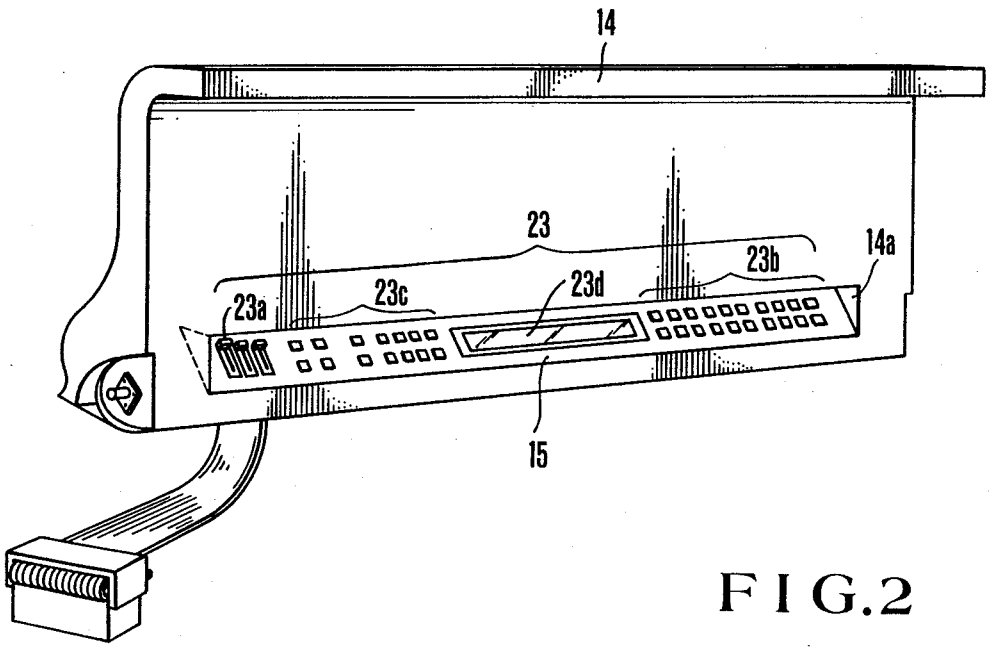
FIG. 2 is an enlarged perspective view of a fallboard shown in FIG. 1.
Figure 3:
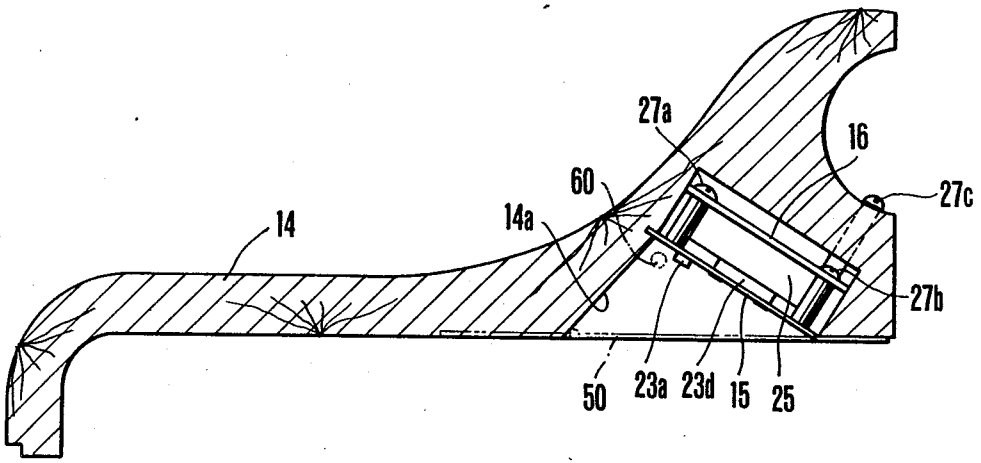
FIG. 3 is a sectional view of the fallboard shown in FIG. 2.

Referring to FIG. 1, reference numeral 11 denotes a grand piano as a keyboard musical instrument. The grand piano 11 comprises a keyboard 12 having a large number of keys aligned parallel to each other, and a fallboard 14 which has two side ends pivotally supported to a body 13 and which can be closed to cover the keyboard 12. As shown in FIGS. 2 and 3, a recess **14*a* is formed in the lower inner surface of the fallboard 14. An operation panel 15 and a printed circuit board 16 are assembled by screws 27*a*, 27*b* and are fallen in the recess 14*a* to be fixed therein by screws 27*c*. The operation panel 15 and the printed circuit board 16 can be mounted by modifying only the fallboard 14 dealt as a subassembled component. Other components of the piano 11 need not be modified. Therefore, the components of the grand piano 11 are interchangeable with those of the ordinary acoustic grand piano. Moreover, since the operation panel 15 and the printed circuit board 16 are mounted in the inner surface of the fallboard 14, the outer appearance of the grand piano 11, as an acoustic musical instrument, is not degraded. Mounting of the operation panel 15 and the printed circuit board 16 do not adversely affect the sound generation characteristics of the mechanical vibration sound source described below. The operation panel 15 is inclined upwardly at a given angle with respect to the inner surface of the fallboard 14 so that the operation panel may face the performer and that the performer can easily check the operation panel when the fallboard 14** is open.

The operation panel 15 includes a volume control switch 23*a*, a modulation control switch 23*b*, musical tone operation switches 23*c*, and indicators 23*d* (collectively represented by reference numeral 23). These switches and indicators are used to control the volume levels, tone colors, and musical effects of the musical tone signals generated by the electronic keyboard musical instrument. The printed circuit board 16 includes a control circuit 25 (FIG. 4) for sending musical control information corresponding to the operating states of the switches 23 in the operation panel 15. The control circuit 25 mounted on the printed circuit board 16 is connected to a musical tone generation device 17 for the electronic keyboard musical instrument via an MIDI (Musical Instrument Digital Interface) standard I/O terminal (to be referred to as an MIDI terminal hereinafter) 30 and a cable 19. An example of the device 17 is YAMAHA FM tone generator TX816 or a combination of YAMAHA FM tone generators TF116 and TF1 available from Nippon Gakki Co., Ltd.

Frequently used switches can be arranged in the operation panel 15, and rarely used switches may be arranged in an end block or the like of the piano 11.

Figure 4:
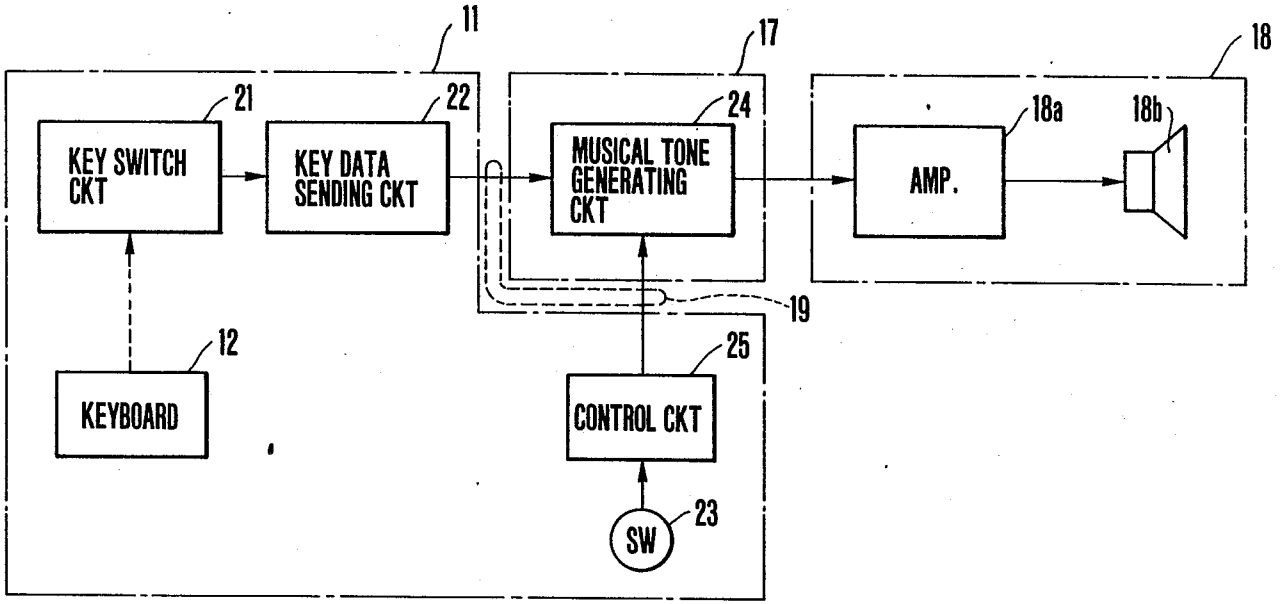
FIG. 4 is a block diagram of an electronic musical instrument used together with the keyboard musical instrument shown in FIG. 1.
Figure 5:
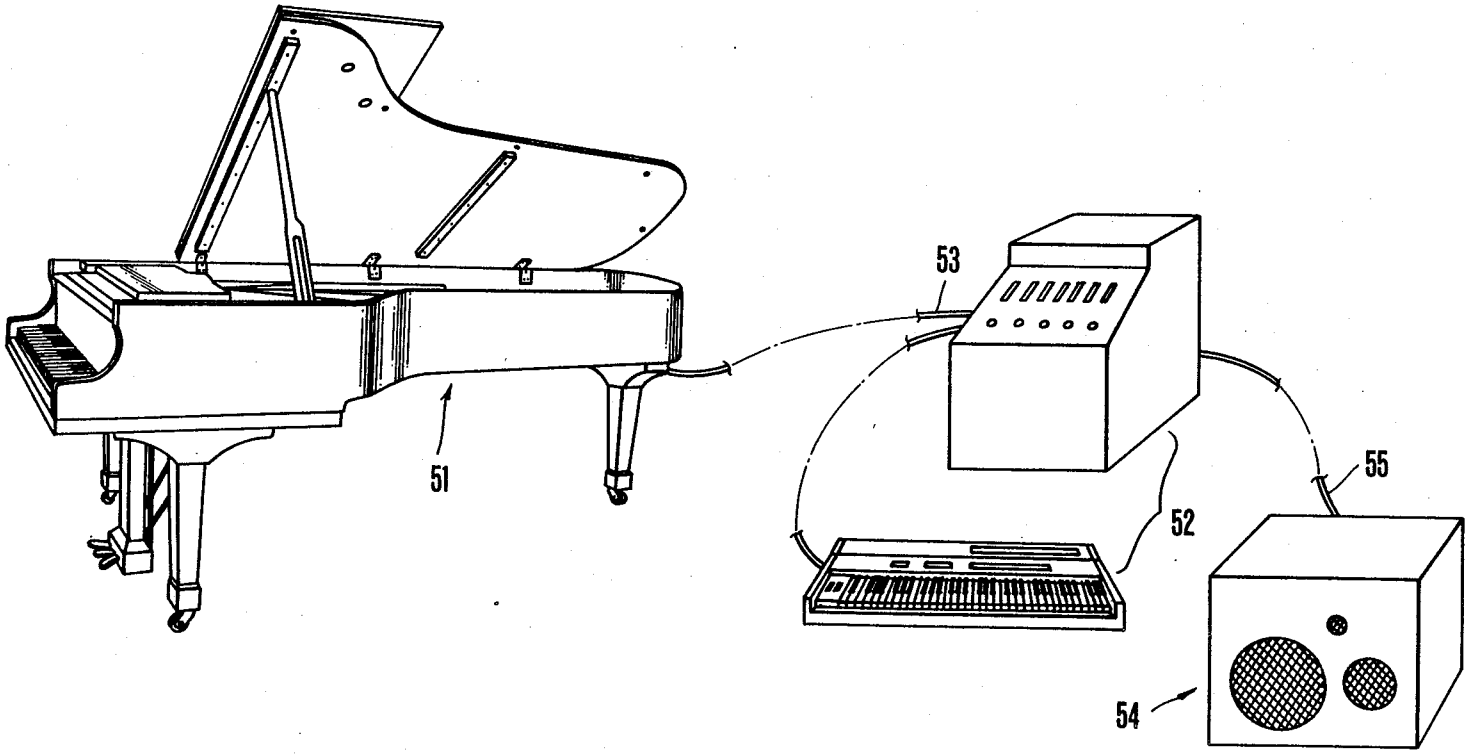
FIG.5 PRIOR ART
FIG. 5 is a perspective view showing connections of a conventional keyboard musical instrument.

The grand piano 11 comprises a mechanical vibration sound source (not shown) for receiving key movement transmitted by a mechanical means and generating a musical tone. As shown in FIG. 4, the grand piano 11 also includes a plurality of key switches 21 for detecting depression of corresponding keys and a key data sending circuit 22 for detecting an output from each key switch 21 and sending out key on/off data and key depression intensity data. The key data sending circuit 22 is connected to the MIDI terminal 30 arranged under the key bed of the piano 11. The MIDI terminal 30 is connected to a musical tone generating circuit 24 in the electronic keyboard musical instrument.

The musical tone generating circuit 24, for the electronic musical instrument, generates a musical tone signal having a pitch and an intensity corresponding to the key depressed at the grand piano 11, on the basis of the key data sent from the key data sending circuit 22. At the same time, the musical tone generating circuit 24 controls a tone color, a volume level, and a musical effect of a musical tone signal generated on the basis of the musical tone control information sent from the control circuit 25. The musical tone signal generated by the musical tone generating circuit 24 is supplied to a sound system 18 comprising an amplifier 18*a* and a loudspeaker 18*b*. The sound system 18 generates a musical tone. Reference numeral 31 denotes a keyboard of the electronic musical instrument which preferably is of MIDI format. An output from the keyboard 31 may be also supplied to the musical tone generating circuit 24, and the corresponding musical tone may be additionally produced at the sound system. The instrument 17 itself may be replaced by a music synthesizer of MIDI format.

In the grand piano 11, the mechanical vibration sound source generates a musical tone when the performer depresses a key. The key data sending circuit 22 sends a musical tone signal to the electronic musical instrument 17. The electronic musical instrument 17 then sends a musical tone signal corresponding to the depressed key to the sound system 18. The corresponding musical tone is produced at the sound system 18. Therefore, when the performer depresses a key at the grand piano 11, a grand piano musical tone as an acoustic musical tone and a corresponding electronic musical tone can be simultaneously produced. The electronic musical tone can be visually controlled by the switches 23 on the operation panel 15 arranged in the fallboard 14 just in front of the performer. The performer can check the musical tones produced upon control of the switches and need not move to the control switches arranged in the electronic musical instrument. In other words, the performer can control the switches in the operation panel for the electronic musical instrument without interrupting his musical performance at the piano keyboard 12. Therefore, various musical expressions can be easily performed during simultaneous operation of the acoustic and electronic keyboard musical instruments. It should be noted that the grand piano 11 can be connected to any musical instrument (e.g., a rhythm box) if it has an MIDI terminal. As a result, various musical expressions can be achieved.

Mounting of the switches of the musical tone control information sending means requires only modification of the fallboard, but does not require modifications of other components. Interchangeability of the components is not impaired, and most of the components can be commonly used. In addition, the outer appearance of the fallboard and hence the keyboard musical instrument is not degraded.

The present invention is not limited to the particular embodiment described above. Various changes and modifications may be made within the spirit and scope of the invention. When the operation panel 15 is not used, i.e., when the acoustic piano does not require simultaneous performance with the electronic musical instrument, the panel 15 may be covered with a cover 50. With this arrangement, the performer feels as if he plays an ordinary acoustic grand piano. A lamp 60 in FIG. 3 may be mounted to turn it on so as to illuminate the surface of the operation panel 15 when the fallboard is opened or the performer operates the switches.

What is claimed is:

1. An acoustic keyboard musical instrument capable of driving an external electronic musical tone generating means, comprising:

a mechanical musical tone generating mechanism;

a keyboard including a plurality of keys aligned on a musical instrument body to drive said mechanical tone generating mechanism and to produce signals to drive said external electronic tone generating means;

a fallboard pivotally coupled to said musical instrument body and adapted to be closed/opened so as to cover/uncover said keyboard;

musical tone controlling means for controlling tones generated by said external electronic tone generating means and including a manual setting section for allowing a performer to set control information for said external electronic tone generating means;

said manual setting section being located at a position opposite to the performer in an inner surface of said fallboard when said fallboard is open; and a cable for coupling said musical tone controlling means to said external electronic tone generating means which is spaced apart from said mechanical musical tone generating means, said cable for sending commands generated by said manual setting section to said external electronic tone generating means.

2. An instrument according to claim 1, further including an MIDI standard coupling device connected between said manual setting section and said electronic tone generating means.

3. An instrument according to claim 1, wherein said manual setting section comprises at least one indicator and switches.

4. An instrument according to claim 1, wherein said manual setting section is inclined upwardly so as to face the performer when said fallboard is open.

5. An instrument according to claim 1, wherein said manual setting section is covered with a cover when said manual setting section is not used.

* * * * *